US005622798A

United States Patent [19]

Kimoto

[11] Patent Number: 5,622,798

[45] Date of Patent: Apr. 22, 1997

[54] ELECTROPHOTOGRAPHIC METHOD WITH RESIDUAL CHARGE ELIMINATION

[75] Inventor: Keizo Kimoto, Osaka, Japan

[73] Assignee: Mita Industrial Co., Ltd., Osaka, Japan

[21] Appl. No.: 542,061

[22] Filed: Oct. 12, 1995

[30] Foreign Application Priority Data

Oct. 13, 1994 [JP] Japan ..... 6-248163

[51] Int. Cl.[6] ..... G03G 21/08

[52] U.S. Cl. ..... 430/31; 430/97

[58] Field of Search ..... 430/31, 97

[56] References Cited

U.S. PATENT DOCUMENTS 4,603,970 8/1986 Aota et al. ..... 355/40 X
4,974,964 12/1990 Yoshihara et al. ..... 366/152.1
5,185,236 2/1993 Shiba et al. ..... 430/505

FOREIGN PATENT DOCUMENTS 259175 9/1991 Japan .

*Primary Examiner*—Roland Martin
*Attorney, Agent, or Firm*—Sherman and Shalloway

[57] ABSTRACT

The electrophotographic process of this invention is characterized in that a single layer organic photosensitive material having an absorbance, at a maximum absorption wavelength of a visible portion per μm of the thickness of a photosensitive layer, of at least 0.05 is used, and for its charge elimination, a light-emitting diode light which emits a light of a maximum absorption wavelength or a light in its vicinity is irradiated. According to this process, when image formation carried out repeatedly a number of times, a decrease in an early period surface potential can be effectively prevented and a brilliant image can be formed in a high concentration.

16 Claims, 2 Drawing Sheets

ELECTROPHOTOGRAPHIC METHOD WITH RESIDUAL CHARGE ELIMINATION

BACKGROUND OF THE INVENTION

1. Field of the Invention

This invention relates to an electrophotographic method using a single layer organic photosensitive material, and more specifically to an electrophotographic method in which a decrease in the surface potential of the photosensitive material at the time of repeated use is suppressed.

2. Description of the Prior Art

In electrophtography, a photosensitive material is charged to a fixed polarity, the charged photosensitive material is imagewise exposed, the resulting electrostatic latent image is developed with a toner, and the toner image is transferred to a transferring paper to form an image. Since an untransferred toner remains on the photosensitive material after the transferring of the toner, it is cleaned by an elastic plate, and furthermore, to eliminate the remaining charge on the photosensitive material, charge elimination is performed by exposure on the entire surface. Accordingly, the above process is repeatedly carried out.

Various types of photosensitive materials used in electrophotography are known such as a selenium photosensitive material, an amorphous silicon photosensitive material (a-Si) and organic photosensitive materials (OPC). The organic photosensitive materials are suitable for electrophotography of a digital type using a laser light in spectral sensitivity and cost.

Roughly classified, the organic photosensitive materials include a laminated photosensitive material obtained by laminating a charge generating agent layer (CGL) and a charge transporting agent layer (CTL), and a single layer photosensitive material prepared by dispersing a charge generating agent (CGM) and a charge transporting agent (CTM) in a resin. The former has high sensitivity but contains a complicated layer construction and is high in production cost. The latter has the defect that its layer construction is simple, but escape from the charge at the time of exposure is not good (the sensitivity is somewhat low).

It is already known to use a light of a light-emitting diode (LED) for elimination of a charge from a photosensitive material. As a charge eliminating light, light rays of a wavelength to which a photosensitive material has sensitivity are generally used.

For example, Japanese Laid-Open Patent Publication No. 259175/1991 discloses a charge-eliminating apparatus which is used in an electrophotographic copying machine using a photosensitive drum having sensitivity to a red light, which is characterized in that a light-emitting diode which emits light in a long wavelength side of a wavelength region to which the photosensitive drum is sensitive is used as a light source.

SUMMARY OF THE INVENTION

In the case of a usual single layer-type organic photosensitive material, when charge elimination is carried out in a light ray of a wavelength region to which this photosensitive material is sensitive, no such a thing is noted at all. But when a single layer-type organic photosensitive material in which the concentration of a charge generating agent is increased in the photosensitive layer and the absorbancy (namely sensitivity) per unit film thickness is increased is subjected to repeated steps of the process, the surface potential in an early period becomes unstable and, for example, a decrease in the surface potential in an early period reaches about 80 V if image formation is carried out 1000 times.

It is an object of this invention therefore to provide an electrophotographic method capable of forming brilliant images free from texture fogging in a high concentration, in which method a decrease in the surface potential in an early period is suppressed in the repetition of a process for forming the images.

According to this invention, there is provided an electrophotographic process wherein charge elimination of a single layer organic photosensitive material having an absorbance, at a maximum absorption wavelength of a visible portion per μm of the thickness of a photosensitive layer, of at least 0.05, especially at least 0.08 is carried out by using the irradiation of a light-emitting diode which emits a light having a maximum absorption wavelength ($\lambda_{nm}$) of the visible portion of the photosensitive layer or its vicinity, generally $\lambda_{nm}\pm15$ nm, especially preferably $\lambda_{nm}\pm10$ nm.

Any single layer organic photosensitive material may be used. Advantageously, there may be used a dispersion of charge generating agents, especially non-metallic phthalocyanine, and at least one charge transporting agent selected from the group consisting of positive hole transporting agents and electron transporting agents in a resin medium.

DETAILED DESCRIPTION OF THE INVENTION

Increasing of the absorbancy per μm of the unit thickness of the photosensitive layer in a single layer organic photosensitive material can decrease the thickness of the entire photosensitive layer. Accordingly, the escape of a charge at the time of exposure is made feasible, and it helps to increase the sensitivity of the photosensitive layer.

In the present invention, the absorbancy of a maximum absorption wave-of the visible portion per μm of the unit thickness of the photosensitive layer is adjusted to at least 0.05, especially at least 0.08. The above absorbancy can give an increased sensitivity as compared with a conventional photosensitive layer (absorbancy of about 0.03).

However, when charge elimination is carried out by using a light-emitting diode light on a long wavelength side recommended in a conventional example with the use of a single layer organic photosensitive material having the above-mentioned high absorbancy, an early period surface potential is markedly decreased.

Examples to be described below may be referred to.

In a single layer organic photosensitive material having an absorbancy of 0.032/μm ( for details, see Comparative Example 1), when charge elimination is carried out by using an LED light at wavelengths of 610 nm, 630 nm and 650 nm, a decreased amount of the surface potential after 1000 cycles is about 30 volts, and an early period surface potential is stabilized.

On the other hand, when charge elimination is carried out with an LED light at a wavelength of 650 nm using a single layer organic photosensitive material having an absorbancy of 0.084/μm (for details, see Example 1 to be described below), a decreased amount in surface potential after 1000 cycles reaches 100 volts.

Figure 1:
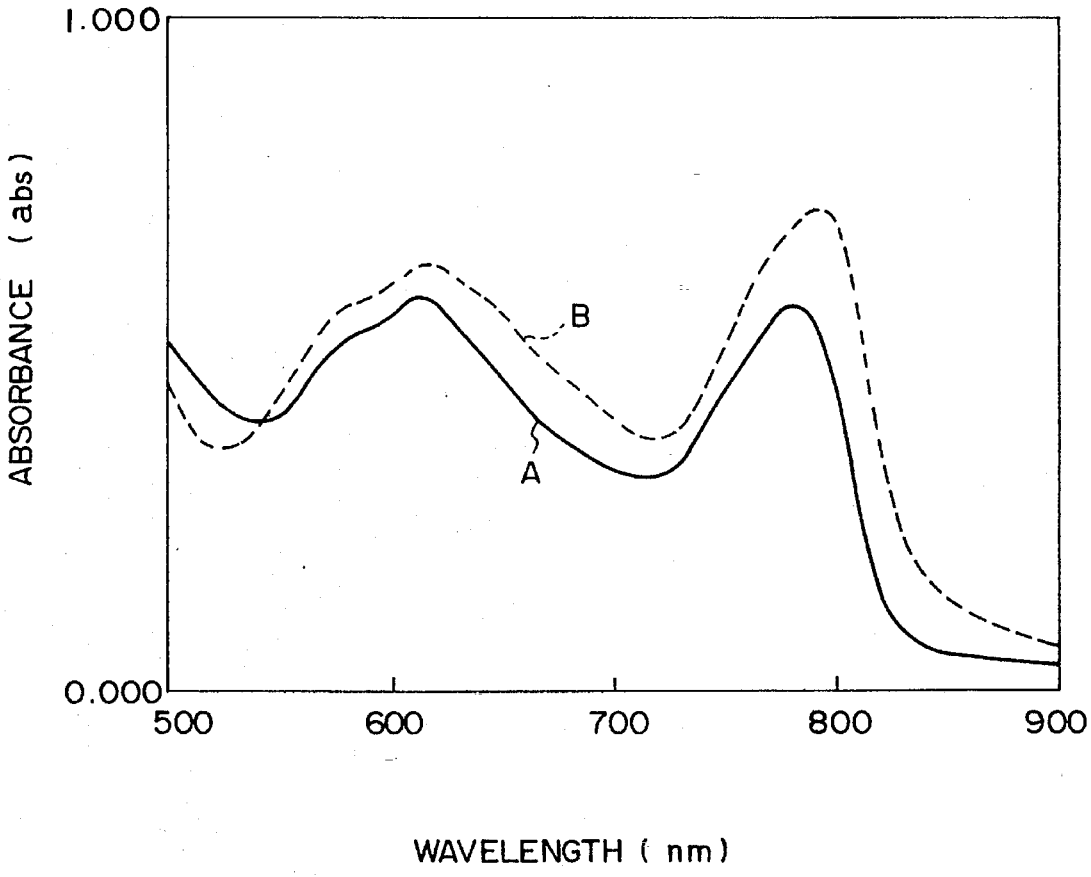
FIG. 1 is a graph showing the relation between each wavelength of a single layer organic photosensitive material and a spectral absorbancy; and, FIG. 2 is an arrangement view showing one example of the apparatus used in the electrophotographic method in accordance with this invention.

The accompanying FIG. 1 shows a spectral absorbancy curve with respect to each wavelength of the photosensitive material. Curve A is a spectral absorbancy curve of the photosensitive material used in Example 1, and curve B is a spectral absorbancy curve of the photosensitive material used in Comparative Example 1.

When a single layer organic photosensitive material having an absorbancy of 0.084/μm is subjected to charge elimination by using a light from an LED which emits maximum absorption wavelengths ($\lambda_{nm}$) of its visible portion, or its vicinity, for example a light ray of 610 nm, a decreased amount of surface potential can be adjusted to 30 volts after 1000 cycles, and a decrease in the concentration of an image can be suppressed at the time of repeating.

The fact that charge elimination with an LED light having a maximum absorption wavelength of a visible portion or its vicinity from a photosensitive layer having a high absorbancy acts effectively for suppressing a decrease in surface potential at the time of repeating has been discovered as a phenomenon from a number of experiments. The reason for this fact has not yet been fully made clear, but light rays of the above-mentioned wavelengths seem to act peculiarly to prevent a charge trap of the photosensitive layer or its accumulation.

In a single layer organic photosensitive material of the type which is prepared by dispersing charge generating agents such as metal-free phthalocyanine, and at least one charge transporting agent selected from the group consisting of hole transporting agents and electron transporting agents in a resin, the contacting area between electron generating agent particles and a charge transporting medium is very great as compared with a laminated photosensitive layer. Accordingly, the generation of a charge trap is great generally. According to the process of this invention, the generation of a charge trap and its accumulation can be effectively prevented.

Figure 2:
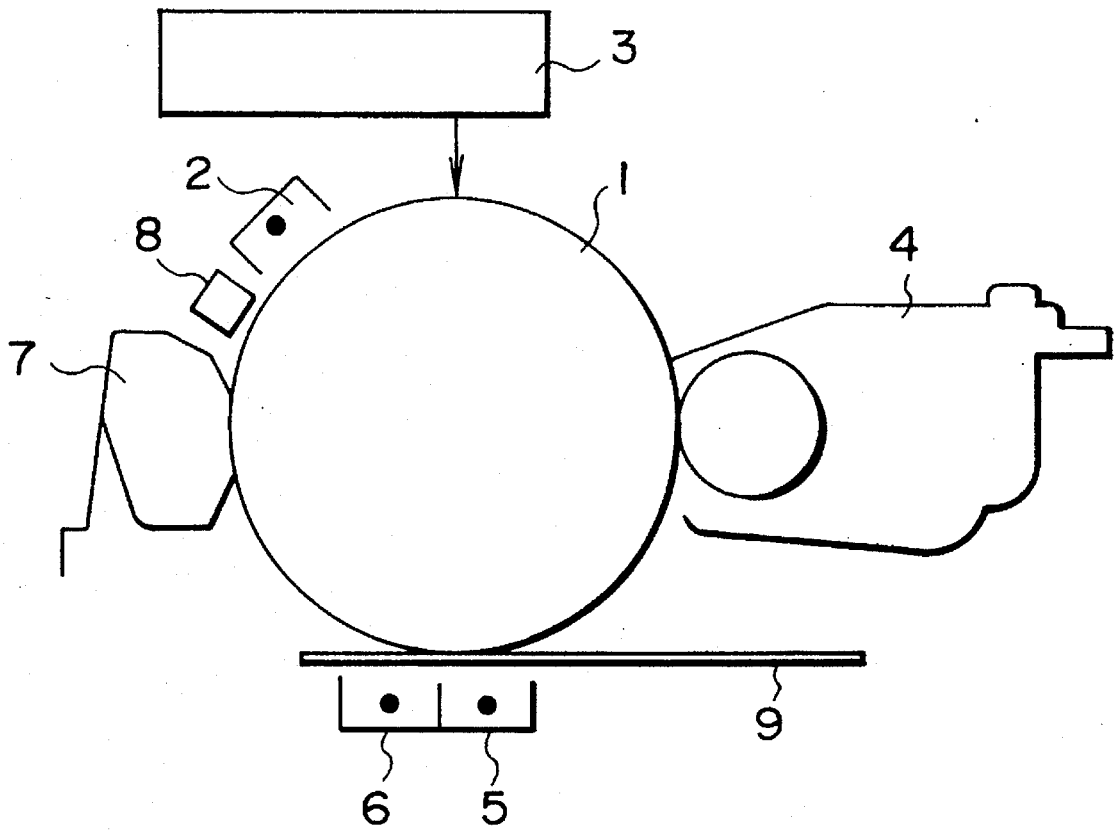

In FIG. 2 which shows one example of the apparatus used in the electrophotography of this invention, this apparatus is composed of a single layer organic photosensitive drum 1 and a main charger 2, a laser light exposer 3, a developer 4, a toner transferring charger 5, a paper separating charger 6, a cleaning device 7 and a charge eliminating LED light source 8 which are sequentially arranged around the drum 1.

The single layer organic photosensitive drum 1 is uniformly charged by the main charger 2, for example a plus corona, in a positive charge, and imagewise exposed with a laser light from the laser light exposer 3 to form a negative electrostatic latent image. A one-component or a two-component developing agent is accommodated in the developing vessel 4 charged to the same polarity as the electrostatic latent image, and by a magnetic brush developing method or other developing methods, a reversal toner image (visible image) is formed on the photosensitive drum 1. A transfer paper 9 is fed so as to contact it with the surface of the photosensitive drum 1, and the back surface of the transfer paper 1 is charged with a 5 negative corona by the transferring charger 5 to transfer the toner image to the transfer paper 9. Thereafter, the back surface of the transfer paper 9 is charged through AC corona charging by the separation charger 6. The transfer paper 9 bearing the toner image is separated from the photosensitive drum 1, and the transfer paper 9 is fed to a fixing device (not shown). The remaining toner on the photosensitive drum 1 after separation of the transfer paper 9 is eliminated by the cleaning device 7 and charge is eliminated from the photosensitive drum 1 by uniform exposure from a charge eliminating LED light source 8. Thus, the above-mentioned image forming process is repeated.

In the present invention, there are used a single layer organic photosensitive material having an absorbance, at a maximum absorption wavelength of a visible portion per μm, of at least 0.05, especially at least 0.08, and for charge elimination of the photosensitive material, a light-emitting diode which emits a light having a maximum absorption wavelength of the visible portion or its vicinity.

As the above-mentioned photosensitive material, there may be used any single layer organic photosensitive material which has the absorbance in the above range. But a positively chargeable photosensitive layer prepared by dispersing charge generating agents (CGM), and at least one charge transporting agent selected from the group consisting of hole transporting agents (HTM) and electron transporting agents (ETM) in a resin is especially preferred.

Examples of the charge generating agents include inorganic photoconductive material powders such as selenium, selenium-tellurium, selenium-arsenic, cadmium sulfide, and a-silicon, azoic pigments, perylene pigments, anthanthrone pigments, phthalocyanine pigments, indigo pigments, triphenylmethane pigments, thiene pigments, toluidine pigments, pyrazoline pigments, quinacridone pigments, and dithioketopyrrolopyrrole pigments. These pigments may be used singly or mixtures of at least two of them.

An especially preferred charge generating agent for the object of this invention is a metal-free phthalocyanine. This compound, as shown in FIG. 1, has two mountains of spectral absorption characteristics in a visible region having a wavelength of 550 to 650 nm, and a near infrared region having a wavelength of 730 to 830 nm.

For the single layer organic photosensitive material containing a metal-free phthalocyanine pigment, a light having the above-mentioned near infrared region is used for imagewise exposure (exposure by using a laser light), and a light ray having the above visible region (satisfying the above-mentioned conditions) can be used for exposure to carry out charge elimination. Furthermore, a light of a visible region may be used for both imagewise exposure and exposure for charge elimination.

As the hole transporting agents (HTM) among the charge transporting agents, electron-donating materials may be used. Examples of the hole transporting agents include diamine compounds, diazole compounds such as 2,5-di(4-methylaminophenyl)-1, 3, 4-oxadiazole, styryl compounds such as 9-(4-diethylaminostyryl) anthracene, carbazole compounds such as poly(vinyl carbazole), pyrazoline compounds such as 1-phenyl-3-(p-dimethylaminophenyl)pyrazoline, hydrazone compounds, triphenylamine compounds, and nitrogen-containing cyclic compounds and fused polycyclic compounds typified by indole compounds, oxazole compounds, isooxazole compounds, thiazole compounds, thiadiazole compounds, imidazole compounds pyrazole compounds compounds, and triazole compounds.

Preferred HTM may include benzidine derivatives of general formula (1)

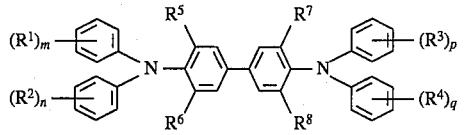

(I)

wherein each of $R^1$, $R^2$, $R^3$ and $R^4$ represents a hydrogen atom, an alkoxy group, a halogen atom or a substituted or unsubstituted aryl group, each of $R^5$, $R^6$, $R^7$ and $R^8$ represents a hydrogen atom or an alkyl group, and m, n, p and q represent an integer of 1 or 2.

Examples of the alkyl group corresponding to R1, R2, R3 and R4 in general formula (1) are lower alkyl groups having 1 to 6 carbon atoms such as a methyl group, an ethyl group, a propyl group, an isopropyl group, a butyl group, an isobutyl group, a tert-butyl group, a pentyl group, and a hexyl group.

Examples of the alkoxy group include a methoxy group, an ethoxy group, an isopropoxy group, a butoxy group, a tert-butoxy group, and a hexyloxy group.

Examples of the halogen atom include a fluorine atom, a chlorine atom, a bromine atom, and an iodine atom.

Examples of the ary group include a phenyl group, a biphenyl group, a naphthyl group, an anthryl group, a phenanthryl group and an o-terphenyl group.

Examples of the substituent which may substitute the aryl group include an alkyl group, a halogen atom and an alkoxy group.

Examples of the alkyl group corresponding to the groups $R^5$, $R^6$, $R^7$ $R^8$ in general formula (1) are lower alkyl groups having 1 to 6 carbon atoms described above, especially a methyl group.

Examples of the electron transporting agents among the charge transporting agents include, for example, electron attractive materials such as diphenoquinone compounds, benzoquinone compounds, naphthoquinone compounds, malononitrile, thiopyran compounds, tetracyanoethylene, tetracyanoquinodimethane, chloroanyl, bromoanyl, 2, 4, 7-trinitro-9-fluorenon, 2, 4, 5, 7-tetranitro-9-fluorenon, 2, 4, 7-trinitro-9-dicyanomethylenefluorenon, 2, 4, 5, 7-tetranitroxanthone, 2,4, 8-trinitrothioxanthone, dinitrobenzene, dinitroanthracene, dinitroacridine, nitroanthraquinone, dinitroanthraquinone, succinic anhydride, maleic anhydride and dibromomaleic anhydride, and polymers of the electron attractive materials.

Preferred ETM include para-diphenoquinone derivatives especially having general formula (2)

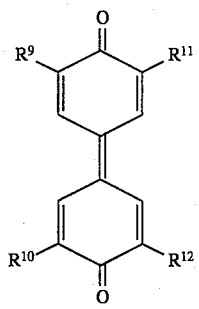

wherein each of $R_9$, $R_{10}$, $R_{11}$ and $R_{12}$ represents a hydrogen atom, an alkyl group, a cycloalkyl group, an aryl group, an aralkyl group, or an alkoxy group.

Suitable examples include, although not limited thereto, 3, 5-dimethyl-3', 5'-di-tert-butyldiphenoquinone, 3, 5-dimethoxy-3', 5'-di-tert-butyldiphenoquinone, 3, 3'-dimethyl-5, 5'-di-tert-butyldiphenoquinone, 3, 5'-dimethyl-3', 5-di-tert-butyldiphenoquinone, 3, 5, 3', 5'-tetrathyldiphenoquinone, 2, 6, 2', 6'-tetra-tert-butyldiphenoquinone, 3, 5, 3', 5'-tetraphenyldiphenoquinone, and 3, 5, 3', 5'-tetracyclohexyldiphenoquinone.

Examples of the resin medium for forming a photosensitive layer include thermoplastic resins such as styrene pollers, a styrene-butadiene copolymer, a styrene-acrylonitrile copolymer, a styrene-maleic acid copolymerer, acrylic copolymers, styrene-acrylic polymers, polyethylene, an ethylene-vinyl acetate copolymer, chlorinated polyethylene, polvinyl chloride, polyropylene, a vinyl chloride-vinyl acetate copolder, polyesters, alkyd resins, polyamides, polyurethanes, polycarbonates, polyallylate, polysulfone, a diallyl phthalate resin, a ketone resin, a polyinyl butyral resin and a polyether resin, crosslinking thermosetting resins such as a silicone resin, an epoxy resin, a phenol resin, a urea resin, a melamine resin and others, and photocurable resins such as epoxy-acrylate or urethane-acrylate. These binder resins may be used singly, or in a mixture of at least two.

The content of the charge generating agent in the photosensitive layer is determined so as to give the above-mentioned asorbance. This content differs depending upon the type of the charge generating agent, but is generally selected from 0.1 to 5 parts by weight, especially 1 to 3 parts by weight, per 100 parts by weight of the resin.

On the other hand, the content of the charge transporting agent may be selected from 10 to 120 parts by weight, especially 20 to 80 parts by weights per 100 parts by weight of the resin so that a combination of optimum sensitivity and surface potential in an early period.

The most preferred charge transporting agent is a combination of the hole transporting agent and the electron transporting agent from the viewpoint of sensitivity. The hole transporting agent and the electron transporting agent may be used in a weight ratio of 9:1 to 1:9, especiaally 8:2 to 2:8.

The electroconductive medium in which the photosensitive layer is provided may include various materials having electroconductivity- Examples may include simple metals such as aluminum, copper, tin, platinum, silver, vanadium, molybdenum, chromium, cadmium, titanium, nickel, palladium, indium, stainless steel, and brass, plastic materials on which the above metals are evaporated or laminated, and glass coated with aluminum iodide, tin oxide, or indium oxide.

The electroconductive substrate may be in the form of a sheet or a drum. The substrate itself may be electroconductive, or the surface of the substrate may be electroconductive. Furthermore, the electroconductive substrate may preferably have sufficient mechanical strength during use.

The thickness of the photosensitive layer may be determined so as to obtain the above-mentioned absorbance per unit film thickness from a thickness of generally 5 to 35 μm, especially 10 to 30 μm.

When the above photosensitive layer is formed by a coating method, the above illustrated charge generating material, charge tranporting material and binder resin are dispersed and mixed together with a solvent by a known method, for example, with the use of a roll mill, a ball mill, an attriter, a paint shaker, or an ultrasonic disperser to prepare a coating solution, and coating and drying the solution by known means.

Various organic solvents may be used to prepare the coating solution. Examples of the solvents include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cyclohexanone; esters such as ethyl acetate and methyl acetate; and dimethylformaldehyde, dimethylformamide and dimethyl sulfoxide. These solvents may be used singly or mixtures composed of at least two of them.

It is possible to add various additives such as sensitizers, fluoren type compounds, ultraviolet absorbers, plasticizers, surface lubricating agents, levelling agents and anti-oxidants in addition to the above-mentioned components to the photosensitive layer. To increase the sensitivity of the photosensitive material, a sensitizer such as terphenyl, halonaphthoquinones and acenaphtylene may be used together with the charge generating material.

The laser light for imagewise exposure in the electrophotographic method of this invention is used a semiconductor laser light conventionally used in laser printers, plain paper facsimiles (PPF) and degital copying. A light ray having a wavelength of 700 to 850 nm in general may be used. Of course, its wavelength should be within a range of spectral sensitivity which the photosensitive layer has.

In the present invention, a light-emitting diode array having a wavelength of 550 to 830 nm may be used for imagewise exposure.

Developers used for developing an electrostatic latent image may be used any known two-component magnetic developers, one-component magnetic developers and one-component non-magnetic developers. Furthermore, operations such as development and transfer may be carried out by known means.

Charge-eliminating light-emitting diode (LED) may be any light-emitting diodes among Pn junction type diodes such as GaAs, $GAs_{1-x}P_x$, GaP and $Al_xGa_{1-x}As$. A plurality of light-emitting diodes are arranged in a line for and connected parallel to a power source via a discharge current limitation resistance. For turning LED on or off, a transistor or a TTL driver may be used.

EXAMPLES

Comparative Example 1

Using the following recipe, a composition for coating the photosensitive layer was prepared.

| | |
|---|---|
| Metal-free phthalocyanine | 1.5 parts by weight |
| N,N'-bis(o,p-dimethylphenyl)-N,N'-diphenyl benzidine | 40 parts by weight |
| 3,3',5,5'-tetraphenyldiphenoquinone | 40 parts by weight |
| Polycarbonate | 100 parts by weight |
| Dichloromethane | 80 parts by weight |

This composition was coated on an aluminum tube having an outside diameter of 30 mm, and dried to give a photosensitive material having a film thickness of 20 μm.

The spectral absorption characteristics of the photosensitive layer are shown in curve B of FIG. 1. It had an absorbance of 0.032 at a maximum absorption wavelength (about 610 nm) of a visible portion per μm of thickness.

This photosensitive material was secured to the electrophotographic apparatus shown in FIG. 2, exposed with laser having a wavelength of 780 nm at an early period surface potential of +700 volts, and charge-eliminated with an LED light having a peak wavelength of 590 nm, 610 nm, 630 nm and 650 nm. The laser exposure amount was prescribed so that the remaining potential (Vr) became 30 volts. This cycle was repeated 1000 times. The difference (ΔV) between the early potential after 1000 cycles and the first early potential was measured.

The results obtained are shown in Table 1.

TABLE 1

| LED light wavelength for charge elimination | Residual potential (Vr) | Early period potential difference (ΔV) |
|---|---|---|
| 590 nm | 80 V | — |
| 610 nm | 30 V | −30 V |
| 630 nm | 30 V | −30 V |
| 650 nm | 30 V | −30 V |

EXAMPLE 1

In the recipe of Comparative Example 1, the content of metal-free phthalocyanine was changed to 2.5 parts by weight, and the thickness of the photosensitive layer was adjusted to 7 μm. Otherwise, a photosensitive material was prepared in the same way as in Comparative Example 1.

The spectral absorption characteristics of the photosensitive layer are shown in curve A of FIG. 1. The absorbance of the photosensitive layer was 0.084/μm at a maximum absorption wavelength (about 610 μm) of a visible portion per μm of thickness. In the same way as in comparative Example 1, the early period potential difference (ΔV) was measured. The results are shown in Table 2.

TABLE 2

| LED light wavelength for charge elimination | Residual potential (Vr) | Early period potential difference (ΔV) |
|---|---|---|
| 590 nm | 60 V | — |
| 610 nm | 30 V | −30 V |
| 630 nm | 30 V | −80 V |
| 650 nm | 30 V | −100 V |

According to the results shown in Table 2, it can be seen that a decrease in the early period potential at the time of repeating can be suppressed by adjusting the peak wavelength of charge-eliminating LED light to a maximum absorption wavelength in the photosensitive layer or its vicinity.

Separately from the early period potential difference measurement, a reversal development experiment was carried out with the use of the apparatus of FIG. 2. For development, the following two-component developing agent was used.

Ten parts by weight of carbon black and 2 parts by weight of a positive charge controlling agent (metal complex salt dyestuff) were melt-kneaded with 100 parts by weight of a styrene-acrylic copoymer. The kneaded mixture was pulverized and classified to prepare a powder having a median diameter of 10 μm. Hydrophobic silica (0.3% by weight) was sprinkled with the resulting mixture to form a toner. The toner and a ferrite carrier having a particle diameter of 100 μm were mixed in a weight ratio of 96.5:3.5 to form a magnetic developer.

When an LED light having 610 mn was used as a charge-eliminating light, the image concentration and the white ground concentration of the 1st sheet and the 1000th sheet were shown as follows:

| | 1st sheet | 1000th sheet |
|---|---|---|
| Image concentration | 1.380 | 1.371 |
| White ground concentration | 0.001 | 0.001 |

When an LED having 650 nm was used as a charge-eliminating light, the results of the developing experiment were as follows:

| | 1st sheet | 1000th sheet |
|---|---|---|
| Image concentration | 1.379 | 1.360 |
| White ground concentration | 0.001 | 0.010 |

EXAMPLE 2

In the recipe of Comparative Example 1, the content of metal-free phthalocyanine was changed to 2.0 parts by weight and the thickness of the photosensitive layer was changed to 11 μm. Otherwise, a photosensitive material was prepared in the same way as in Comparative Example 1.

The photosensitive layer had an absorbance, per μm of its thickness, at a maximum absorption wavelength (about 610 nm) of 0.053.

The early period potential difference (ΔV) was measured in the same way as in Comparative Example 1, and the results are shown in Table 3.

TABLE 3

| LED light wavelength for charge elimination | Residual potential (Vr) | Early period potential difference (ΔV) |
|---|---|---|
| 590 nm | 70 V | — |
| 610 nm | 30 V | −30 V |
| 630 nm | 30 V | −60 V |
| 650 nm | 30 V | −80 V |

According to the present invention, a single layer-type organic photosensitive material having an absorbance of at least 0.05 at a maximum absorption wavelength of a visible portion per μm of the thickness of the photosensitive layer is used, and its charge elimination is carried out by using a light-emitting diode which emits a maximum absorption wavelength of a visible portion of the photosensitive layer or a light ray in its vicinity, whereby when image formation is performed repeatedly, a decrease in an early period surface potential is suppressed and a brilliant image can be formed in a high concentration.

Furthermore, with such a single layer-type organic photosensitive layer, the thickness of the photosensitive layer can be decreased and the escape of a charge at the time of exposure is excellent. Furthermore, since the sensitivity is high and the process of this invention has good repeating properties, an image free from ground fogging can be formed stably in a high concentration over an extended period of time.

What is claimed is:

1. An electrophotographic process wherein charge elimination of a single layer organic photosensitive material having an absorbance, at a maximum absorption wavelength of a visible portion per μm of the thickness of a photosensitive layer, of at least 0.05 is carried out by using the irradiation of a light-emitting diode light which emits a light having a maximum absorption wavelength of a visible portion of the photosensitive layer ±10 nm is irradiated.

2. An electrophotographic process of claim 1, wherein the light-emitting diode light emits a light having a maximum absorption wavelength about the same as the photosensitive layer is irradiated.

3. An electrophotographic process of claim 1, wherein the photosensitive layer is prepared by dispersing charge generating agents, and at least one charge transporting agent selected from the group consisting of hole transporting agents and electron transporting agents in a resin.

4. An electrophotographic process of claim 3, wherein the charge transporting agent is composed of a combination of the hole transporting agent and the electron transporting agent.

5. An electrophotographic process of claim 3, wherein the charge generating agent is a metal-free phthalocyanine.

6. An electrophotographic process of claim 4, wherein the hole transporting agent and the electron transporting agent are used in a weight ratio of 9:1 to 9:1.

7. An electrophotographic process wherein charge elimination of a single layer organic photosensitive material having an absorbance, at a maximum absorption wavelength of a visible portion per μm of the thickness of a photosensitive layer, of about 0.05 to 0.084 is carried out by using the irradiation of a light-emitting diode light which emits a light having a maximum absorption wavelength about the same as a visible portion of the photosensitive layer is irradiated.

8. An electrophotographic process of claim 7, wherein the light-emitting diode light emits a light having a maximum absorption wavelength of the photosensitive layer of about 610 nm is irradiated.

9. An electrophotographic process of claim 7, wherein the photosensitive layer is prepared by dispersing charge generating agents, and at least one charge transporting agent selected from the group consisting of hole transporting agents and electron transporting agents in a resin.

10. An electrophotographic process of claim 9, wherein the charge transporting agent is composed of a combination of the hole transporting agent and the electron transporting agent.

11. An electrophotographic process of claim 9 wherein the charge generating agent is a metal-free phthalocyanine.

12. An electrophotographic process wherein charge elimination of a single layer organic photosensitive material having an absorbance, at a maximum absorption wavelength of about 610 nm of a visible portion per μm of the thickness of a photosensitive layer, of about 0.05 to 0.084 is carried out by using the irradiation of a light-emitting diode light which emits a light having a maximum absorption wavelength about the same as a visible portion of the photosensitive layer is irradiated, wherein the photosensitive layer is prepared by dispersing a metal free phthalocyanine charge generating agent, and at least one charge transporting agent selected from the group consisting of hole transporting agents and electron transporting agents in a resin.

13. An electrophotographic process of claim 12, wherein the light-emitting diode light emits a light having a maximum absorption wavelength of the photosensitive layer of about 610 nm is irradiated.

14. An electrophotographic process of claim 12, wherein the charge transporting agent is composed of a combination of the hole transporting agent and the electron transporting agent.

15. An electrophotographic process of claim 14, wherein the hole transporting agent and the electron transporting agent are used in a weight ratio of 9:1 to 9:1.

16. An electrophotographic process of claim 12 wherein the photosensitive layer has a thickness of 5 to 35 μm.

* * * * *